US007051885B2

(12) United States Patent
Belokin et al.

(10) Patent No.: US 7,051,885 B2
(45) Date of Patent: May 30, 2006

(54) CROSS-MERCHANDISING DISPLAY SHELF

(75) Inventors: Paul Belokin, Denton County, TX (US); Martin P. Belokin, Denton County, TX (US); Norman P. Belokin, Denton County, TX (US)

(73) Assignee: Displays by Martin Paul, Inc. - Creative Center, Denton, TX (US)

( * ) Notice: Subject to any disclaimer, the term of this patent is extended or adjusted under 35 U.S.C. 154(b) by 199 days.

(21) Appl. No.: 10/407,989

(22) Filed: Apr. 7, 2003

(65) Prior Publication Data

US 2004/0195194 A1 Oct. 7, 2004

(51) Int. Cl.
*A47F 5/08* (2006.01)

(52) U.S. Cl. ..... 211/87.01; 211/75; 211/88.01; 211/59.1

(58) Field of Classification Search ..... 211/183, 211/87.01, 57.1, 59.1, 88.01, 90.01, 71.01, 211/72, 94.01, 74, 75
See application file for complete search history.

(56) References Cited

U.S. PATENT DOCUMENTS

| | | | | |
|---|---|---|---|---|
| 30,064 | A | 1/1860 | Andreen | |
| 133,923 | A | 12/1872 | Cook | |
| 1,069,411 | A | 8/1913 | Greene | |
| 1,226,231 | A | 5/1917 | Mack | |
| 1,243,059 | A | 10/1917 | Friesleben | |
| 1,291,349 | A | 1/1919 | Ackers | |
| 1,330,684 | A | 2/1920 | Chwala | |
| 1,331,427 | A | 2/1920 | Frank | |
| 1,518,943 | A | 12/1924 | Story | |
| 1,540,285 | A | 6/1925 | Reynolds | |
| 1,610,834 | A | 12/1926 | Webster | |
| 1,634,953 | A | 7/1927 | McCune, et al. | |
| 1,659,777 | A | 2/1928 | Learned | |
| 1,715,237 | A | 5/1929 | Huston | |
| 1,738,030 | A | 12/1929 | Bebb | |
| 1,739,801 | A | 12/1929 | Pitts | |
| 1,768,715 | A | 7/1930 | Hopp et al. | |
| 1,840,763 | A | 1/1932 | Benchley | |
| 1,847,016 | A | 2/1932 | Metcalfe | |
| 1,904,456 | A | 4/1933 | Healy | |
| 1,933,374 | A | 10/1933 | Haggard | 211/90 |
| 2,004,005 | A * | 6/1935 | McDanal | 351/110 |
| 2,028,694 | A | 1/1936 | Spinks | 211/87 |
| 2,040,315 | A | 5/1936 | Kress | 211/50 |
| 2,122,336 | A | 6/1938 | Berry | 211/88 |
| 2,123,549 | A | 7/1938 | Williams | 248/363 |
| 2,235,741 | A | 3/1941 | Ford | 248/206 |
| 2,275,299 | A | 3/1942 | Hummert | 240/52.2 |

(Continued)

FOREIGN PATENT DOCUMENTS

| | | |
|---|---|---|
| IT | 552195 | 11/1956 |

(Continued)

OTHER PUBLICATIONS

U.S. Appl. No. 10/144,304, entitled *Display Shelf for Stackable Products,* listing inventors Paul Belokin, et al., filed May 13, 2002.

(Continued)

*Primary Examiner*—Jennifer E. Novosad

(57) ABSTRACT

Shelf units adapted to be mounted on vertical walls for displaying merchandise are adapted to utilize removeable hooks which are used for cross-merchandising complimentary products. The shelf unit is also adapted to be mounted on the exterior face of a wall, door or window of a refrigerated vault or the like and to prevent air from migrating down the wall between the wall and the shelf unit.

20 Claims, 3 Drawing Sheets

U.S. PATENT DOCUMENTS

| | | | | | |
|---|---|---|---|---|---|
| 2,291,381 | A | | 7/1942 | Drake | 211/60 |
| 2,347,423 | A | | 4/1944 | McCarty | 40/10 |
| D144,450 | S | | 4/1946 | Cohen | D74/1 |
| 2,451,194 | A | | 10/1948 | Braun | 248/206 |
| 2,453,030 | A | | 11/1948 | Newman | 211/49 |
| 2,467,873 | A | | 4/1949 | Weir | 211/74 |
| 2,472,058 | A | | 6/1949 | Artley | 248/108 |
| 2,491,652 | A | | 12/1949 | Feerick | 211/90 |
| 2,498,956 | A | | 2/1950 | Johnson | 40/2 |
| 2,508,945 | A | | 5/1950 | Heuer | 211/75 |
| 2,512,502 | A | | 6/1950 | Paschell | 211/60 |
| 2,557,434 | A | | 6/1951 | Hoverder | 248/206 |
| 2,568,405 | A | | 9/1951 | O'Malley | 211/133 |
| 2,580,676 | A | | 1/1952 | Gross | 211/74 |
| 2,593,697 | A | | 4/1952 | Reilly | 211/86 |
| 2,595,002 | A | | 4/1952 | Schneider | 211/137 |
| 2,647,786 | A | | 8/1953 | Locke | 294/87.28 |
| 2,647,787 | A | | 8/1953 | Locke | 294/87.28 |
| D171,595 | S | | 3/1954 | Harriton | D4/3 |
| 2,711,830 | A | | 6/1955 | Howell | 211/75 |
| 2,714,965 | A | | 8/1955 | Fitzkee, et al. | 211/113 |
| 2,717,717 | A | | 9/1955 | Busch | 220/18 |
| 2,728,488 | A | | 12/1955 | Hankins | 222/112 |
| 2,741,913 | A | | 4/1956 | Dovas | 73/61 |
| 2,826,471 | A | | 3/1958 | Fonda | 312/36 |
| 2,852,030 | A | | 9/1958 | Nord | 134/179 |
| 2,916,161 | A | | 12/1959 | Schaefer | 211/126 |
| 2,947,422 | A | | 8/1960 | Sudbery | 211/47 |
| 2,974,804 | A | | 3/1961 | Maro | 211/60 |
| 3,059,952 | A | | 10/1962 | Wittman, et al. | 292/288 |
| 3,139,258 | A | | 6/1964 | Handler, et al. | 248/243 |
| 3,182,809 | A | | 5/1965 | Getoor | 211/88 |
| 3,187,902 | A | | 6/1965 | Nelson | 211/60 |
| 3,220,558 | A | | 11/1965 | Olsson | 211/74 |
| 3,228,737 | A | | 1/1966 | Kipnis | 312/206 |
| 3,239,069 | A | | 3/1966 | Hollins | 211/60 |
| 3,252,678 | A | * | 5/1966 | Lasch et al. | 248/220.31 |
| 3,268,282 | A | | 8/1966 | Harvey | 312/204 |
| 3,300,055 | A | | 1/1967 | Rohr | 211/74 |
| 3,342,343 | A | * | 9/1967 | Youlden | 211/88.01 |
| 3,344,974 | A | | 10/1967 | Bostrom | 229/43 |
| 3,407,939 | A | | 10/1968 | Villar-Kelly | 211/90 |
| 3,433,548 | A | | 3/1969 | Moore | 312/184 |
| 3,449,848 | A | | 6/1969 | Howell | 40/125 |
| 3,465,763 | A | | 9/1969 | Hoffman | 134/154 |
| 3,469,711 | A | | 9/1969 | Swaneck, et al. | 211/176 |
| D216,938 | S | | 3/1970 | Nestegard | D96/12 |
| 3,612,821 | A | | 10/1971 | Stromquist | 219/218 |
| 3,649,069 | A | | 3/1972 | Zip | 296/97 D |
| D228,737 | S | | 10/1973 | Mathews | D8/230 |
| 3,799,467 | A | | 3/1974 | Bauman | 242/55.2 |
| 3,824,720 | A | | 7/1974 | Langwell | 40/10 |
| D232,282 | S | | 8/1974 | Wagschal | D6/114 |
| 3,863,568 | A | | 2/1975 | Frederick | 102/13 |
| 3,901,389 | A | | 8/1975 | Belokin, Jr. | 211/74 |
| 3,938,666 | A | | 2/1976 | Castleberry | 211/49 D |
| D239,348 | S | | 3/1976 | Vrignaud | D6/136 |
| 3,984,931 | A | | 10/1976 | Belokin, Jr. | 40/130 C |
| D245,140 | S | | 7/1977 | Benson | D7/99 |
| D248,128 | S | | 6/1978 | Mineo | D2/400 |
| 4,094,415 | A | * | 6/1978 | Larson | 211/57.1 |
| 4,099,626 | A | | 7/1978 | Magnussen, Jr. | 211/60 R |
| 4,106,828 | A | | 8/1978 | Belokin, Jr. | 312/107 |
| 4,108,084 | A | | 8/1978 | Fink | 108/29 |
| D250,555 | S | | 12/1978 | Belokin, Jr. | D96/12 R |
| 4,136,474 | A | | 1/1979 | Belokin, Jr. | 40/559 |
| 4,155,459 | A | | 5/1979 | Marschak | 211/49 R |
| 4,193,351 | A | | 3/1980 | Belokin, Jr. | 108/59 |
| 4,200,346 | A | | 4/1980 | Belokin, Jr. | 312/351 |
| 4,261,294 | A | | 4/1981 | Bescherer | 119/51 R |
| 4,278,176 | A | | 7/1981 | Adams | 211/74 |
| D261,960 | S | | 11/1981 | Mathews | D6/114 |
| 4,305,512 | A | | 12/1981 | Mackenzie | 211/75 |
| D262,666 | S | | 1/1982 | Tager | D3/23 |
| 4,326,761 | A | | 4/1982 | Schwartz | 312/326 |
| D264,786 | S | | 6/1982 | Faas et al. | D6/184 |
| 4,343,172 | A | | 8/1982 | Nordlund | 72/339 |
| D267,744 | S | | 1/1983 | Flynn | D24/31 |
| 4,373,642 | A | | 2/1983 | Wolters et al. | 220/72 |
| 4,376,521 | A | | 3/1983 | Walters | 248/206 R |
| 4,403,702 | A | | 9/1983 | Belokin, Jr. | 211/189 |
| 4,442,778 | A | | 4/1984 | Lang | 108/111 |
| D275,918 | S | | 10/1984 | Taylor | D6/510 |
| 4,476,983 | A | | 10/1984 | Fast | 211/57.1 |
| 4,479,584 | A | | 10/1984 | Raz | 211/89 |
| 4,480,756 | A | | 11/1984 | Belokin, Jr. | 211/126 |
| 4,488,653 | A | | 12/1984 | Belokin | 211/184 |
| 4,497,464 | A | | 2/1985 | Fast | 248/220.3 |
| 4,499,688 | A | | 2/1985 | Droll | 47/83 |
| 4,500,059 | A | * | 2/1985 | Papizan | 248/205.1 |
| 4,508,303 | A | | 4/1985 | Beckerer, Jr. | 248/311.2 |
| 4,546,943 | A | | 10/1985 | Fast | 248/205.3 |
| 4,560,072 | A | | 12/1985 | Burrell | 211/75 |
| 4,576,292 | A | | 3/1986 | Percival | 211/49.1 |
| 4,607,875 | A | | 8/1986 | McGirr | 296/97 D |
| 4,608,773 | A | | 9/1986 | White | 40/606 |
| 4,618,115 | A | | 10/1986 | Belokin, Jr. | 248/174 |
| 4,630,740 | A | | 12/1986 | Belokin, Jr. | 211/194 |
| D290,564 | S | | 6/1987 | Belokin, Jr. | D6/474 |
| D291,176 | S | | 8/1987 | Sokol | D8/380 |
| 4,687,094 | A | * | 8/1987 | Allsop et al. | 206/774 |
| 4,706,917 | A | | 11/1987 | Thalenfeld | 248/205.1 |
| 4,713,899 | A | | 12/1987 | Fast | 40/10 R |
| D294,442 | S | | 3/1988 | Bordian | D6/528 |
| 4,763,796 | A | | 8/1988 | Flum | 211/59.2 |
| 4,765,495 | A | | 8/1988 | Bisk | 211/113 |
| 4,782,959 | A | | 11/1988 | Kral et al. | 211/59.2 |
| 4,830,198 | A | | 5/1989 | Colquitt | 211/706 |
| 4,854,246 | A | | 8/1989 | Belokin et al. | 108/111 |
| 4,872,568 | A | | 10/1989 | Lehmann | 211/113 |
| 4,901,872 | A | | 2/1990 | Lang | 211/133 |
| 4,909,397 | A | * | 3/1990 | Huber | 211/46 |
| 4,918,848 | A | | 4/1990 | Stein | 40/584 |
| 4,928,833 | A | | 5/1990 | Huizenga | 211/187 |
| D309,687 | S | | 8/1990 | Embree et al. | D6/567 |
| D310,245 | S | | 8/1990 | von Canal | D20/21 |
| D310,748 | S | | 9/1990 | Embree et al. | D34/40 |
| 4,961,506 | A | | 10/1990 | Lang | 211/188 |
| D312,959 | S | | 12/1990 | Hamann | D8/367 |
| 4,984,693 | A | * | 1/1991 | Belokin et al. | 211/88.01 |
| D316,790 | S | | 5/1991 | Robbins et al. | D6/574 |
| 5,014,860 | A | | 5/1991 | Emery | 211/106 |
| 5,031,778 | A | | 7/1991 | Edgecombe | 211/13 |
| D318,962 | S | | 8/1991 | Price, Jr. et al. | D6/407 |
| 5,039,045 | A | | 8/1991 | Adams et al. | 248/206.2 |
| 5,039,046 | A | | 8/1991 | Brewster | 248/206.3 |
| 5,046,274 | A | | 9/1991 | David | 40/604 |
| 5,060,897 | A | | 10/1991 | Thalenfeld | 248/220.4 |
| D322,361 | S | | 12/1991 | Goodman et al. | D6/323 |
| D323,766 | S | | 2/1992 | Robbins et al. | D7/590 |
| 5,087,005 | A | | 2/1992 | Holoff et al. | 248/205.8 |
| 5,088,606 | A | | 2/1992 | Boas | 211/571 |
| 5,096,272 | A | | 3/1992 | Belokin, Jr. et al. | 312/129 |
| RE33,913 | E | | 5/1992 | Kral et al. | 211/59.2 |
| D327,197 | S | | 6/1992 | Belokin, Jr. et al. | D6/567 |
| 5,141,115 | A | | 8/1992 | Nicoll | 211/55 |
| 5,154,304 | A | * | 10/1992 | McAuley | 211/59.1 |
| 5,165,947 | A | | 11/1992 | Colucci et al. | 426/124 |
| 5,176,346 | A | | 1/1993 | Liu | 248/206.1 |
| 5,181,777 | A | | 1/1993 | Segill et al. | 362/405 |
| 5,183,166 | A | | 2/1993 | Belokin, Jr. et al. | 211/149 |
| 5,232,103 | A | | 8/1993 | Koenig | 211/69.5 |
| D340,607 | S | | 10/1993 | Hubbard | D6/567 |
| 5,263,760 | A | | 11/1993 | Sohol | 296/97.7 |

| | | | | | |
|---|---|---|---|---|---|
| 5,305,897 | A | * | 4/1994 | Smith | 211/85.7 |
| D347,538 | S | | 6/1994 | Fleischer | D6/567 |
| 5,330,261 | A | | 7/1994 | Bennett | 312/321.5 |
| 5,339,967 | A | | 8/1994 | Valiulis | 211/57.1 |
| D351,524 | S | | 10/1994 | Belokin, Jr. | D6/570 |
| 5,351,841 | A | | 10/1994 | Belokin et al. | 211/88 |
| 5,358,128 | A | | 10/1994 | Belokin et al. | 211/75 |
| D353,294 | S | | 12/1994 | Belokin et al. | D6/567 |
| 5,373,939 | A | | 12/1994 | Bloomgren | 206/341 |
| D354,646 | S | | 1/1995 | Weinstein | D6/567 |
| 5,381,990 | A | | 1/1995 | Belokin et al. | 248/205.9 |
| 5,390,837 | A | | 2/1995 | Ruffolo, Jr. | 224/42.45 R |
| D357,219 | S | | 4/1995 | Ferris | D11/156 |
| 5,409,667 | A | | 4/1995 | Elson | 422/104 |
| 5,415,297 | A | | 5/1995 | Klein et al. | 211/40 |
| 5,447,243 | A | | 9/1995 | Graber | 211/69.5 |
| 5,464,103 | A | | 11/1995 | O'Brien | 211/133 |
| 5,486,044 | A | | 1/1996 | Bennett | 312/321.5 |
| 5,511,752 | A | | 4/1996 | Trethewey | 248/205.9 |
| D370,806 | S | | 6/1996 | Sklovsky | D6/510 |
| 5,524,980 | A | | 6/1996 | Carter et al. | 312/351 |
| 5,544,764 | A | | 8/1996 | Cima | 211/60.1 |
| 5,547,088 | A | | 8/1996 | Belokin et al. | 211/87 |
| D375,861 | S | | 11/1996 | Belokin, Jr. | D6/570 |
| D378,254 | S | | 3/1997 | Markson | D6/449 |
| 5,615,782 | A | | 4/1997 | Choe | 211/70.6 |
| 5,651,520 | A | | 7/1997 | Belokin et al. | 248/205.9 |
| 5,655,671 | A | | 8/1997 | Barry et al. | 211/70 |
| 5,655,673 | A | | 8/1997 | Weterrings et al. | 211/75 |
| 5,664,689 | A | | 9/1997 | Mirlisena, Sr. | 211/88.01 |
| 5,678,699 | A | | 10/1997 | Gebka | 211/57.1 |
| 5,678,795 | A | | 10/1997 | Henry et al. | 248/220.41 |
| D386,214 | S | | 11/1997 | Belokin et al. | D20/42 |
| 5,683,003 | A | | 11/1997 | Gebka | 211/57.1 |
| D387,981 | S | | 12/1997 | Mosior et al. | D9/418 |
| 5,711,501 | A | | 1/1998 | Belokin et al. | 248/205.9 |
| 5,718,343 | A | | 2/1998 | Belokin et al. | 211/188 |
| D392,144 | S | | 3/1998 | Vogler | D6/574 |
| 5,722,625 | A | | 3/1998 | Kenney | 248/220.41 |
| D393,767 | S | | 4/1998 | Belokin et al. | D6/514 |
| 5,749,479 | A | | 5/1998 | Belokin et al. | 211/113 |
| D394,775 | S | | 6/1998 | Anderson et al. | D6/574 |
| D395,777 | S | | 7/1998 | Belokin et al. | D6/567 |
| D395,972 | S | | 7/1998 | Levy | D6/515 |
| D398,180 | S | | 9/1998 | Winter et al. | D6/574 |
| D400,384 | S | | 11/1998 | Belokin et al. | D6/574 |
| D402,838 | S | | 12/1998 | Sherbet | D6/515 |
| 5,850,917 | A | | 12/1998 | Denton et al. | 206/366 |
| D407,295 | S | | 3/1999 | Belokin et al. | D8/349 |
| 5,875,902 | A | * | 3/1999 | Emery et al. | 211/90.03 |
| 5,880,713 | A | | 3/1999 | Belardinelli | 345/156 |
| D409,035 | S | | 5/1999 | Belokin et al. | D6/574 |
| 5,901,386 | A | | 5/1999 | Bragalone | 4/496 |
| D410,359 | S | | 6/1999 | Belokin et al. | D6/574 |
| D410,969 | S | | 6/1999 | Sexton et al. | D20/43 |
| 5,913,433 | A | * | 6/1999 | Belokin et al. | 211/90.01 |
| 5,927,840 | A | | 7/1999 | Bzowski | 312/321.5 |
| D412,421 | S | | 8/1999 | Belokin et al. | D6/574 |
| D413,036 | S | | 8/1999 | Belokin et al. | D6/574 |
| D413,473 | S | | 9/1999 | Belokin et al. | D6/574 |
| D413,474 | S | | 9/1999 | Belokin et al. | D6/574 |
| 5,964,437 | A | | 10/1999 | Belokin et al. | 248/205.5 |
| D420,567 | S | | 2/2000 | Laga et al. | D8/373 |
| D420,798 | S | | 2/2000 | Belokin et al. | D3/304 |
| 6,029,827 | A | * | 2/2000 | Valiulis | 211/59.1 |
| 6,082,687 | A | | 7/2000 | Kump et al. | 248/220.41 |
| RE36,827 | E | | 8/2000 | Belokin et al. | 211/75 |
| D429,436 | S | * | 8/2000 | Belokin et al. | D6/570 |
| D430,766 | S | | 9/2000 | Sorensen et al. | D6/574 |
| 6,119,990 | A | | 9/2000 | Kump et al. | 248/220.22 |
| D434,080 | S | | 11/2000 | Belokin et al. | D20/10 |
| D435,382 | S | | 12/2000 | Sorensen et al. | D6/574 |
| 6,189,248 | B1 | | 2/2001 | Nagel et al. | 40/661.03 |
| 6,220,437 | B1 | | 4/2001 | Knoy, Jr. et al. | 206/454 |
| 6,289,618 | B1 | | 9/2001 | Kump et al. | 40/657 |
| 6,341,755 | B1 | | 1/2002 | Kump | 248/220.41 |
| D454,055 | S | | 3/2002 | Belokin et al. | D8/373 |
| 6,354,546 | B1 | | 3/2002 | Mueller | 248/220.42 |
| 6,446,374 | B1 | | 9/2002 | Ardiff | 40/593 |
| 6,532,691 | B1 | | 3/2003 | Carlin et al. | 40/491 |
| 6,571,967 | B1 | | 6/2003 | Belokin et al. | 211/71.01 |
| 6,581,314 | B1 | | 6/2003 | Valiulis | 40/642.01 |
| 6,588,606 | B1 | | 7/2003 | Miller, Jr. et al. | 211/88.01 |
| 6,622,875 | B1 | | 9/2003 | Humphrey | 211/85.14 |
| 6,698,124 | B1 | | 3/2004 | Kump et al. | 40/642.02 |
| D488,017 | S | | 4/2004 | Belokin et al. | D6/574 |
| 2002/0148795 | A1 | | 10/2002 | Miller, Jr. et al. | |
| 2003/0080078 | A1 | | 5/2003 | Belokin et al. | |
| 2003/0116516 | A1 | | 6/2003 | Belokin, et al. | |
| 2003/0222037 | A1 | | 12/2003 | Belokin et al. | |
| 2004/0055981 | A1 | | 3/2004 | Walsh, et al. | |

FOREIGN PATENT DOCUMENTS

| | | |
|---|---|---|
| NL | 8100-314 | 8/1982 |

OTHER PUBLICATIONS

U.S. Appl. No. 10/407,990, entitled *Display Assembly,* listing inventors Paul Belokin, et al., filed Apr. 7, 2003.

U.S. Appl. No. 10/864,504; entitled *Vehicle Container,* listing inventors Paul Belokin, et al., filed Jun. 14, 2004

U.S. Appl. No. D29/202,179, entitled *Display Shelf With Curvature,* listing inventors Paul Belokin, et al., filed Mar. 26, 2004.

U.S. Provisional Patent Application, Serial No. 60/556,732, entitled *Display Shelf Curvature,* listing inventors Paul Belokin, et al., filed Mar. 26, 2004.

* cited by examiner

CROSS-MERCHANDISING DISPLAY SHELF

This invention relates to display of products in product containers such as bottles, cans, boxes, wrappers, packets and the like. More particularly, it relates to merchandise display shelves adapted for mounting on one face of a substantially vertical wall to support products on the wall and display the products and graphics such as advertising and the like associated with the products on the shelf as well as other products in adjacent areas.

Retail businesses commonly display chilled or frozen products for sale in refrigerated vaults or the like which have a transparent door or wall panel. Because a passing customer is more likely to select and purchase merchandise displayed where it can be readily seen and recognized, the retailer desires to maximize visibility of products on display as well as advertising graphics associated with the products on display.

Various devices are used to support and display products on a vertical surface such as a wall, door or the like. Most such display devices either display no advertising graphics (relying on visibility of the product itself to advertise the product) or have advertising graphics associated with a particular product permanently formed in or affixed to the display device. Typical of such arrangements are display shelves such as shown in U.S. Pat. No. 5,913,433 wherein advertising graphics are displayed on a face of the support panel to be visible through the transparent wall to which the support panel is attached.

Advertising graphics associated with merchandise displayed for sale greatly increase visibility of the product and thus promote sales. Moreover, it has been determined that display of different types of products which are often used in a complimentary fashion (e.g., pancake mix and syrup; dessert toppings and ice cream; pasta and pasta sauces, etc.) promotes sales of both products. Such associated display of complimentary products (generally referred to as "cross-merchandising"), however, is often difficult to accomplish and often requires display baskets, racks, shelves, etc., adapted for only a single use. For example, shelves adapted to be supported on the inside surface of a transparent wall and display product through the transparent wall (see, for example, U.S. Design Pat. No. 429,436) are not particularly useful for mounting on the outside surface of a transparent wall because, inter alia, the back wall of the display shelf may obscure the product being displayed. Furthermore, trays or shelves, with openings in the floor or back wall (as currently used for mounting on the inside of vault doors), when mounted on the outside surface of refrigerated vault doors or walls, permit escape of cooled air moving down the outside surface of refrigerated vault doors.

Display shelves for cross-merchandising should be inexpensive and sufficiently versatile to permit other uses and should advantageously display products and advertising graphics when used as a stand-alone display or a cross-merchandising display.

In accordance with the present invention, display shelves adapted to be mounted on a substantially vertical panel such as a glass window, wall, door or the like are provided with removeable support hooks or posts adapted to support product or product packages directly below the floor of the shelf. The support hooks are removeable so that the display shelf may be used without the hooks as a stand-alone display or with the support hooks as a cross-merchandising display. The shelf is adapted to prevent or substantially impede the flow of air between the shelf and the wall on which it is supported so that the shelf may trap cooled air moving down the outside face of the supporting vertical panel of a refrigerated vault and thereby maintain the product displayed on the shelf at a temperature lower than ambient. The shelf may thus be mounted either on the inside wall of a transparent panel (to display product through the supporting panel) or on the outside of the supporting panel to utilize the cooled air which migrates down the outer surface of a refrigerated vault door or the like. Other features and advantages of the invention will become more readily understood from the following detailed description taken in connection with the appended claims and attached drawing in which:

Figure 1:
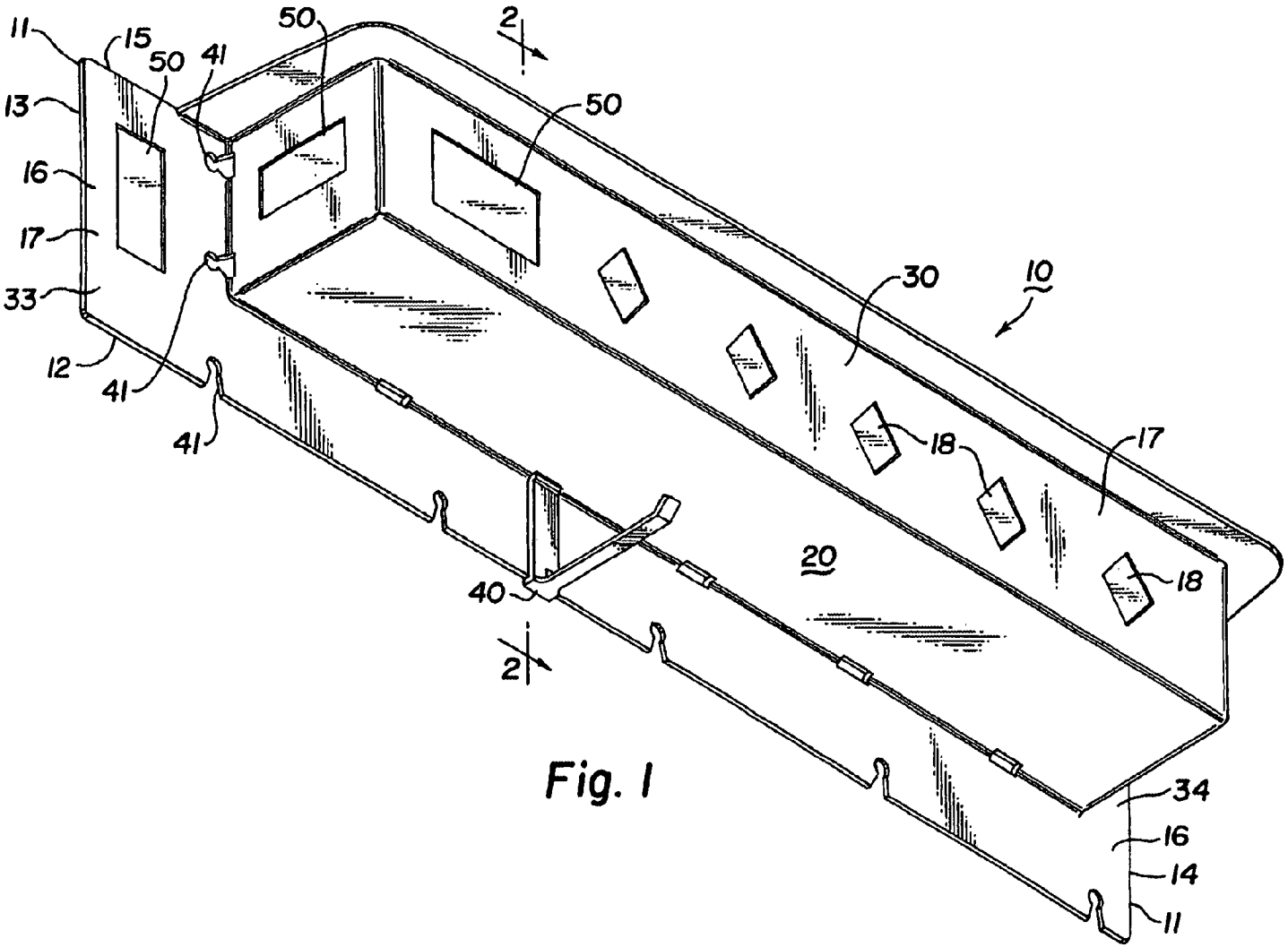
FIG. 1 is a back bottom perspective view of a display shelf with removeable display hooks in accordance with the invention.

The above-described drawing is incorporated into and forms part of the specification to illustrate exemplary embodiments of the present invention. Throughout the drawing, like reference numerals designate corresponding elements. The figures are not to scale but are intended to disclose the inventive concepts by illustration. The drawing is not to be construed as limiting the invention to the illustrated and described examples.

It will be recognized that the principles of the invention may be utilized and embodied in many and various forms. In order to demonstrate these principles, the invention is described herein by reference to specific preferred embodiments. The invention, however, is not limited to the forms illustrated and described. Furthermore, the invention is not limited to use in connection with doors on refrigerated vaults but my find utility in other similar applications involving support and display of products and advertising media.

For purposes of this disclosure, the term "hook" is used to mean any structure on which a product, a package containing a product, or advertising media for a product may be suspended for display. Similarly, the term "shelf" is used to mean any structure having a floor on which a product, a package containing a product, or advertising media may be placed for display.

For perspective and consistency in describing the display shelf illustrated, the portion of the shelf unit which is closest the supporting vertical panel is described as the front and the portion most remote from the supporting panel is described as the back regardless of whether the display shelf is mounted on the inside surface or outside surface of the supporting panel.

Figure 2:
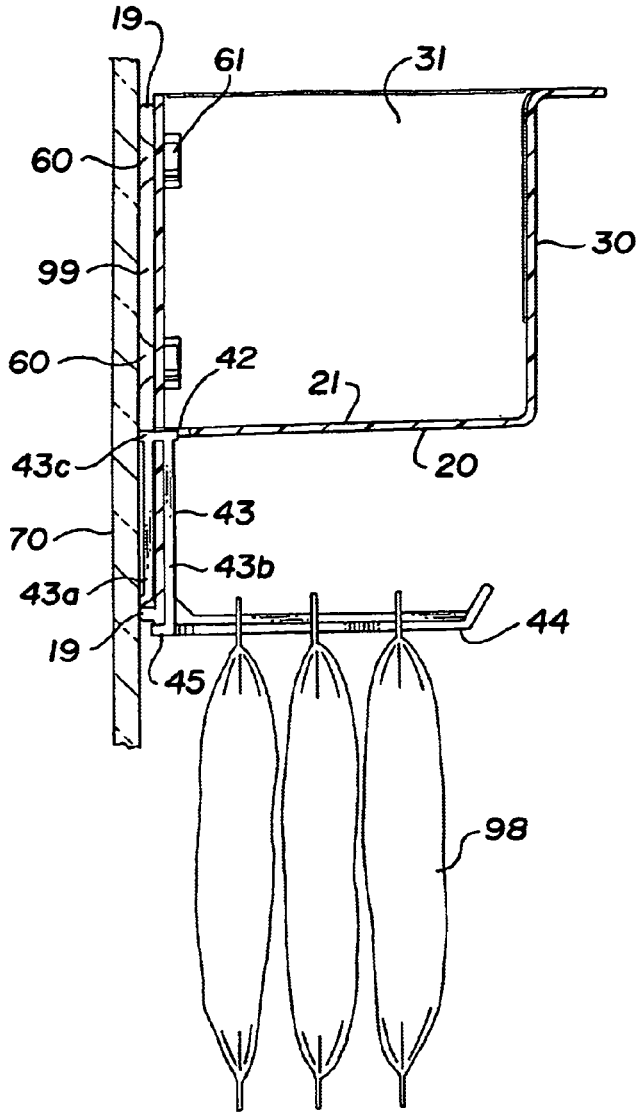
FIG. 2 is a sectional view of the display shelf of FIG. 1 taken through line 2—2 illustrating display of products on the removeable support hooks with the display shelf mounted on the outside of a transparent wall.
Figure 3:
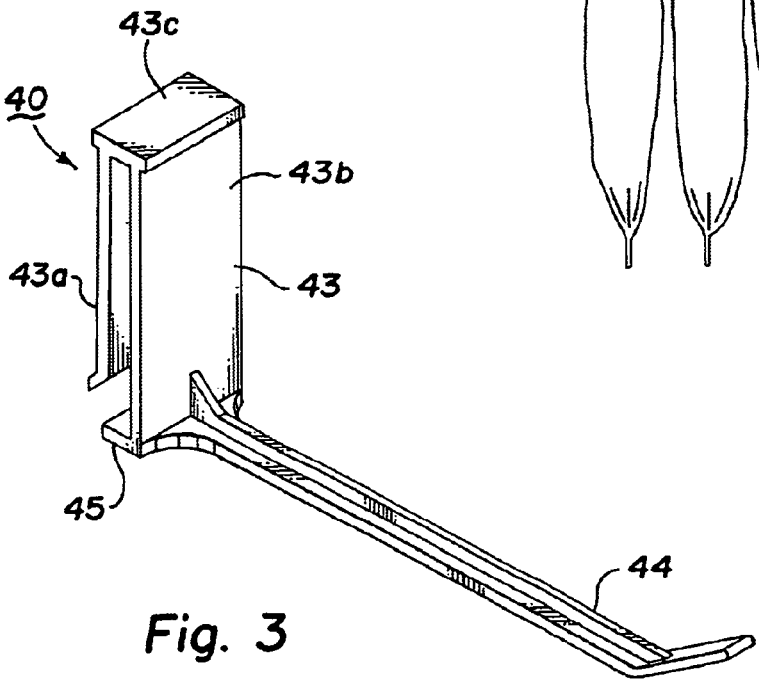
FIG. 3 is a perspective view of the removeable display hook shown in FIGS. 1 and 2.
Figure 4:
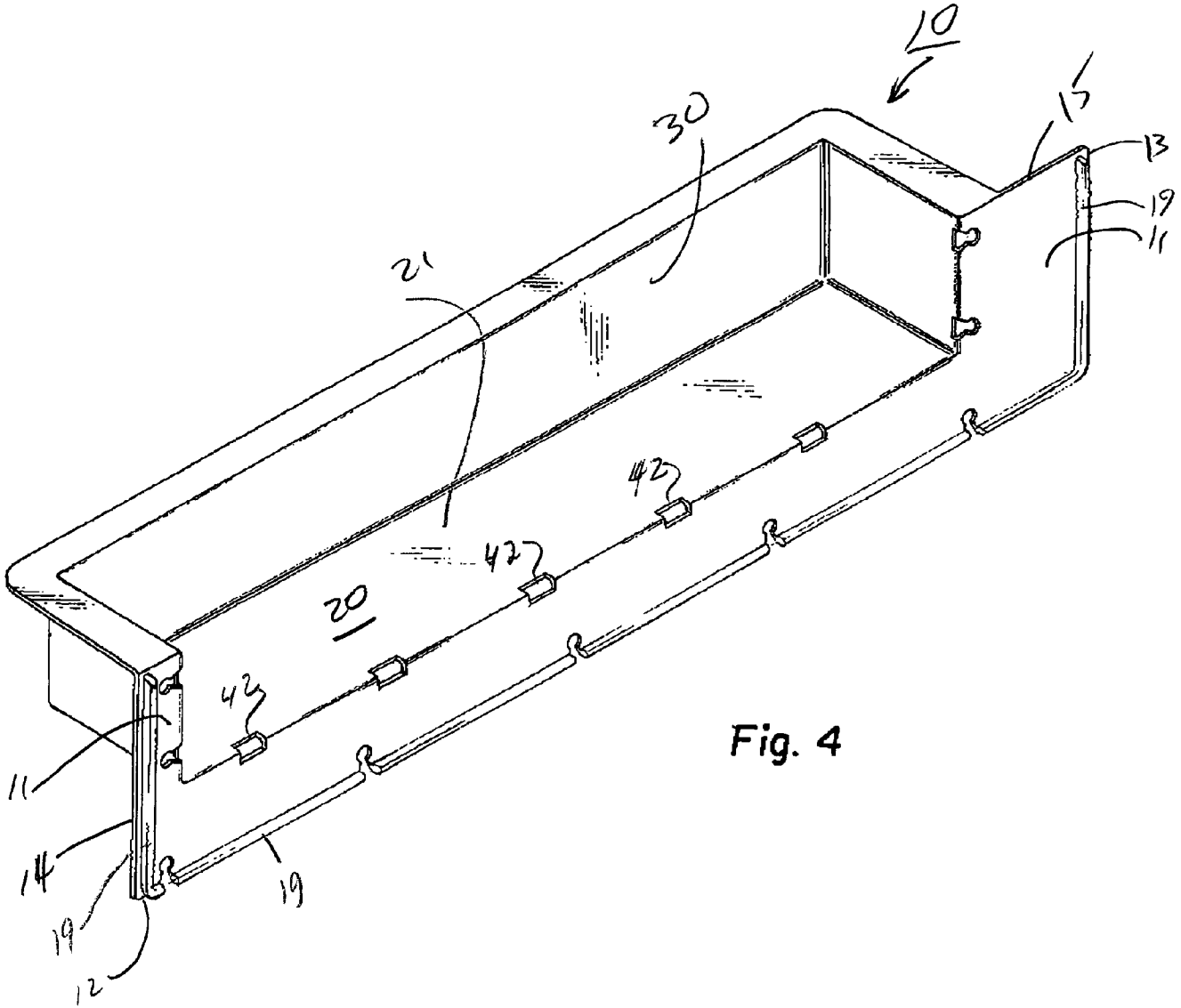
FIG. 4 is a front perspective view of the display shelf of FIG. 1.

The embodiment illustrated in FIGS. 1, 2 and 4 comprises a display shelf 10 with a removeable support hook 40. The display shelf 10 comprises a mounting or support panel 16 which has a first face 11 lying in a substantially vertical plane and defining lower edge 12, first and second laterally opposed end edges 13, 14 and upper edge 15. Floor 20 is supported on the support panel 16 and has a top face 21 which lies in a plane substantially normal to the plane of first face 11. The horizontal plane of top face 21 intersects the plane of the first face 11 well below the upper edge 15 of the lateral ends of the support panel. The support panel 16 does not extend into the area directly above the floor 20 for a substantial lateral portion thereof between the laterally opposed edges 13, 14 so that products supported on floor 20 may be placed directly adjacent the wall 70 on which the shelf is mounted and thus visible through the wall 70 when the wall 70 is transparent.

A containment wall 30 extends upwardly from the top face 21 of the floor 20. A major portion of containment wall 30 is spaced horizontally from the plane of first face 11 of the support panel 16. The ends of the containment wall 30, however, extend toward the support panel 16 to define a open-topped cavity 31 defined by floor 20, containment wall 30 and the wall 70 (see FIG. 2) on which the display shelf 10 is mounted. In the embodiment shown in FIG. 1, the ends of containment wall 30 join support panel 16 at positions interiorly spaced from first and second edges 13, 14 and the support panel 16 extends upwardly from the plane of top face 21 of the floor 20 and outwardly from the ends of the containment wall 30 to define flanges 33, 34. Flanges 33, 34 thus form coplanar spaced apart portions of support panel 16.

In the embodiment illustrated in FIGS. 1, 2 and 4 the containment wall 30 (except for the ends thereof joined to flanges 33, 34) is substantially flat in the vertical plane. However, the containment wall 30 may be shaped to define a plurality of vertically extending semi-cylindrical sections shaped to define individual containment compartments for a plurality of individual vertically arranged cylindrical or otherwise vertically extending products or packages. Obviously, shapes other than arcuate or semi-cylindrical may be employed, depending on the shape and dimensions of the product units to be displayed. Accordingly, it is to be understood that terms such as "containment wall" and "open-topped cavity" as used herein are meant to describe structures which prevent an object placed on the top face 21 of floor 20 from falling off the floor 20 and are not intended to describe fully enclosed compartments.

In the embodiment illustrated the first face 11 of support panel 16 is positioned substantially parallel with the surface of a wall 70 on which the shelf 10 is mounted and extends below the floor 20. Thus first face 11 may conveniently be used to display advertising or the like which is visible through a transparent wall 70 immediately below the product supported by the shelf 10. Positioning the support panel 16 to extend the full length of and past the outer edges of floor 20 provides rigid support for the floor 20 and permits display of advertising or other information associated with the displayed product on the support panel 16 without obstructing view of the displayed product.

The outer edges of support panel 16 terminate in flanges 33, 34 as described hereinabove. As illustrated in FIG. 1, the flanges 33 and 34 may include slots 41 for mounting the support panel 16 adjacent the surface of a wall 70 as shown in FIG. 2. Various means for securing the support panel 16 to the wall 70, such as suction cups 60 or the like, may be used. As illustrated in FIG. 2, suction cups 60 each have a shank 61 which extends through a slot 41 to support the first face 11 of support panel 16 parallel with a surface of wall 70. While use of suction cups is illustrated in FIG. 2, it will be readily appreciated that various other means such as adhesives, clamps, magnets, bolts and the like may be used to attach the display shelf 10 to a wall 70. All such mounting means, however, result in mounting first face 11 substantially adjacent and parallel with the wall 70 but spaced from the wall 70 forming a space 99 between the face of wall 70 and first face 11 of the display shelf 10. The depth or thickness of space 99 is, of course, determined by the mounting means used.

In the embodiment illustrated in FIG. 1 some slots 41 are formed at the inner edges of flanges 33, 34. If desired (and to permit more secure mounting of the shelf) slots 41 may be formed in the lower edge 12 of support panel 16 and arranged so that the entrance of each slot 41 is at the lower edge of support panel 16. Alternatively (or in conjunction with other slots, holes or the like), slots 41 may be formed in flanges 33, 34 and arranged to have their entrances at the outer edges of the flanges. It will be appreciated that various other combinations and arrangements of slots, holes and the like may be used to mount the display shelf adjacent a supporting wall.

Where the shelf 10 is mounted on the inside face of a transparent wall 70, advertising or other graphic information may be displayed on the front of face 11. The graphic information is displayed directly below the product supported on the floor 20 and thus visible through wall 70. When the shelf 10 is mounted on the outside of wall 70, advertising or other graphic information may be displayed on the outer face 17 (opposite first face 11) of support panel 16 and/or containment wall 30. Obviously, when the shelf 10 is made of transparent materials, the graphics may be affixed to either first face 11 or outer face 17 and oriented to be visible in the mounting arrangement used.

In many retail establishments, pricing information and the like is encoded in bar code strips or the like displayed on the product and/or on the shelf on which the product is displayed. In order to conveniently display pricing information and to permit electronic scanning of such bar code strips, the strips must be placed in close proximity with the product and in a position which permits unobstructed viewing. For this purpose, the display shelf 10 includes flat surfaces 50 on the outer vertical face of containment wall 30 and/or support panel 16. The flat surfaces 50 may be in the form of depressions in the surface of wall 30 (or support panel 16); may be flat raised areas; or may be simply surface areas uninterrupted and unobstructed by slots 41 or other structures, advertising media or decorations.

As described hereinabove, the display shelf 10 may be mounted on the inside of a transparent wall 70 so that product placed on shelf 20 may be viewed (from the left in FIG. 2) through the transparent wall 70. The display shelf 10 may also be mounted on the outside of a wall 70 so that product is supported and viewed from the outer side (from the right in FIG. 2) of wall 70.

When the wall 70 is the door or wall of a refrigerated vault or the like, ambient air adjacent the outer face of wall 70 is cooled by thermal conduction through the wall 70. Since cold air is denser than warm air, the air immediately adjacent the outer surface of a refrigerated vault door or wall tends to sink or migrate down the wall. In many cases, it is desireable that products placed on a shelf 10 supported on the outer surface of a wall 70 be maintained at reduced temperatures. Mounting the display shelf 10 so that products placed thereon may be maintained immediately adjacent the wall 70 permits the product to be cooled by thermal conduction through the wall 70 and by the cooler air adjacent the wall 70. However, cooled air migrating down the outer surface of wall 70 may pass directly down wall 70 through the space 99 between the wall 70 and the shelf 10. To avoid such escape of migrating air and to trap the cooled air in the cavity 31, ridges 19 are positioned on the first face 11 of support panel 16 near the periphery thereof. The ridges 19 extend outwardly from first face 11 a distance substantially co-extensive with the depth of space 99 (approximately the thickness of compressed suction cups 60 or other mounting means) so that the ridges contact the outer surface of wall 70. The ridges 19 thus form a seal which substantially prevents flow of air between the face of wall 70 and the display shelf 10. Accordingly, cool air migrating down the face of wall 70 is trapped by ridges 19 and flows into the cavity 31 to cool products supported thereon.

In many display shelves (such as disclosed in U.S. Pat. No. 5,913,433) the containment wall 30 includes vertical slots or the like for decorative purposes and to assist in removal of product from the shelf 10. Since slots or other openings in the floor 20 or containment wall 30 would permit escape of cooled air, the ornamental or decorative effect of slot openings and the like in containment wall 30 is provided by ornamental raised areas or depressions 18 in containment wall 30. The ornamental depressions 18 may take any desired shape or form; may be formed in either the inside face of the outside face of the containment wall 30; and may be colored, stained or otherwise decorated to provide the desired ornamental or decorative effect.

The shelf 10 of FIGS. 1, 2 and 4 is adapted to accommodate removeable support hooks 40 for use in cross-merchandising displays. The hooks 40 are adapted to suspend advertising media individual products or products contained in packages 98 and the like directly below the floor 20 of shelf 10 as shown in FIG. 2. The hooks 40 are preferably used to support and display products which are related to the product displayed in the floor 20 of shelf 10 to increase visibly and thus promote cross-merchandising of both products. The hooks 40 (and the floor 20) could, of course, be used to support advertising media.

In the preferred embodiment the shelf 10 includes a plurality of apertures 42, either in the floor 20, the support panel 16 or both. Each aperture 42 is adapted to receive and support a hook 40 as illustrated in FIG. 2.

In the preferred embodiment hook 40 comprises a base flange 43 which supports a hook, post, prong or arm 44 extending therefrom. Arm 44 may take any desired shape and is adapted to support product or packages 98 directly below floor 20 as shown in FIG. 2. Flange 43 is preferably in the form of an inverted U having an inner leg 43*a* arranged parallel with and joined to an outer leg 43*b* by a connecting base member 43*c*. In the preferred embodiment apertures 42 are formed in the junction of floor 20 and support panel 16 so that aperture 42 extends into floor 20 and support panel 16. The top plan dimensions of connecting base 43*c* are substantially coextensive with the top plan dimensions of apertures 42 and the distance separating parallel legs 43*a* and 43*b* approximates the thickness of support panel 16. In this configuration, hook 40 may be removeably mounted on display shelf 10 by inserting arm 44 through aperture 42 from the top surface 21 of floor 20 and sliding the legs 43*a*, 43*b* along opposite sides of support panel 16 until connecting base 43*c* occupies aperture 42. Inner leg 43*a* may be shorter than outer leg 43*b* to assist in insertion and removal from aperture 42. If desired, outer leg 43*b* may have an inwardly projecting lip 45 adapted to fit under and adjacent lower edge 12 to rigidly secure the hook 40 to the shelf 10.

In the configuration illustrated, hooks 40 may be attached and removed as desired. Accordingly, the shelf 10 may be used by attaching it to the inside surface of a transparent wall or door to support and display products through the transparent wall or door or, if desired, used by attaching it to the outside face of a wall or door to support and display products on the outside of the wall or door. Since hooks 40 are removeable, they may be used in connection with the display shelf when desired or removed to permit the display shelf 10 to be used alone. When the shelf 10 is mounted on the outside of a door or wall of a refrigerated vault or the like, the hooks 40 may be used to support and display related cross-merchandised products or advertising media while obstructing apertures 42 to assist in trapping cooled air in the cavity 31 of display shelf 10.

The shelf and hook structure of the invention may readily be fabricated from any of various suitable materials. In the preferred embodiment, the structures are formed of molded plastics, acrylics or the like to form unitary transparent, translucent or tinted bodies. Obviously, various other materials and manufacturing technologies may be used as desired.

From the foregoing it will be recognized that the principles of the invention may be employed in various arrangements to obtain the benefit of the many advantages and features disclosed. It is to be understood, therefore, that even though numerous characteristics and advantages of the invention have been set forth together with details of the structure and function of the invention, this disclosure is to be considered illustrative only. Various changes and modifications may be made in detail, especially in matters of size, shape and arrangements and combination of parts, without departing from the spirit and scope of the invention as defined by the appended claims.

What is claimed is:

1. A combination comprising:

(a) a shelf for supporting and displaying products adjacent one face of a substantially vertical panel comprising:

(i) a support panel having a first face lying in a substantially vertical plane and defining first and second laterally opposed end edges;

(ii) a floor having a top face lying in a substantially horizontal plane substantially normal to said vertical plane between the laterally opposed end edges of said support panel;

(iii) a containment wall extending upwardly from the top face of said floor with a substantial portion thereof spaced horizontally from and substantially parallel with the plane of said first face of said support panel; and (iv) an opening in said floor substantially adjacent the vertical plane of said support panel; and (b) a hook having a support arm and an attachment flange, said attachment flange extending through said opening in said floor and supporting said support arm in a position below said floor and extending toward the plane of said containment wall.

2. A combination as defined in claim 1 wherein said attachment flange comprises first and second substantially parallel legs joined by a base member to define a substantially U-shaped flange body.

3. A combination as defined in claim 2 wherein the base member substantially occupies said opening in said floor.

4. A combination as defined in claim 1 including means projecting from said first face adapted to impede flow of air between said first face and a support wall on which said shelf is mounted.

5. A combination as defined in claim 4 wherein said means projecting from said first face is a ridge adjacent the outer periphery of said first face.

6. A combination comprising:

(a) a shelf for supporting and displaying products adjacent one face of a substantially vertical panel comprising:

(i) a support panel having a first face lying in a substantially vertical plane and defining first and second laterally opposed end edges;

(ii) a floor having a top face lying in a substantially horizontal plane substantially normal to said vertical plane between the laterally opposed end edges of said support panel;

(iii) a containment wall extending upwardly from the top face of said floor with a substantial portion thereof spaced horizontally from and substantially parallel with the plane of said first face of said support panel; and (iv) an opening in said support panel; and (b) a hook having a support arm and an attachment flange, said attachment flange extending through said opening in said support panel and supporting said support arm in a position below said floor and extending toward the plane of said containment wall.

7. A combination as defined in claim 6 wherein said attachment flange comprises first and second substantially parallel legs joined by a base member to define a substantially U-shaped flange body.

8. A combination as defined in claim 7 wherein the base member substantially occupies said opening in said panel.

9. A combination as defined in claim 6 including means projecting from said first face adapted to impede flow of air between said first face and a support wall on which said shelf is mounted.

10. A combination as defined in claim 9 wherein said means projecting from said first face is a ridge adjacent the outer periphery of said first face.

11. A combination comprising:

(a) a shelf for supporting and displaying products; comprising:

(i) a support panel having a first face and defining first and second laterally opposed end edges;

(ii) a floor adjacent the support panel and operable to support products, wherein at least a portion of the support panel extends below the floor;

(iii) an opening in said floor; and (iv) a containment wall extending upwardly from the floor with at least a portion thereof spaced from the first face of the support panel; and (b) a hook disposed through said opening in the floor coupled to the shelf and operable to support products below the floor.

12. A combination as defined in claim 11 wherein the hook is removably coupled.

13. A combination, arranged and designed for mounting on a supporting wall, comprising:

(a) a shelf for supporting and displaying products adjacent a supporting wall comprising:

(i) a support panel having a first face and defining first and second laterally opposed end edges;

(ii) a horizontally disposed floor supported by and extending from said support panel and operable to support products;

(iii) a containment wall extending upwardly from said floor with at least a portion thereof spaced from the first face of the support panel; and (iv) a cavity defined at least partially by said floor, said containment wall and said supporting wall; and (b) a hook coupled to the shelf and operable to support products below the floor.

14. A combination as defined in claim 13 wherein the hook is removably coupled.

15. A combination as defined in claim 13 wherein the hook is coupled to the support panel.

16. A combination as defined in claim 13 wherein the shelf is made of plastic.

17. A combination as defined in claim 13 wherein the floor includes an opening and the hook is disposed through the opening in the floor.

18. A combination as defined in claim 13 wherein the support panel includes an opening and the hook is disposed through the opening in the support panel.

19. A combination comprising:

(a) a shelf for supporting and displaying products comprising:

(i) a support panel having a first face and at least one flange;

(ii) an opening in said support panel;

(iii) a floor adjacent the support panel and operable to support products;

(iv) a containment wall extending upwardly from the floor with at least a portion thereof spaced from the first face of the support panel; and (v) an opening in said floor; and (b) a hook coupled to the shelf disposed through said opening in said floor and said opening in said support panel and operable to support products below the floor.

20. A shelf adapted to be mounted adjacent a substantially vertical wall for supporting and displaying products adjacent one face of said substantially vertical wall comprising:

(i) a support panel having a first face lying in a substantially vertical plane and defining first and second laterally opposed end edges;

(ii) a floor having a top face lying in a substantially horizontal plane substantially normal to said vertical plane between the laterally opposed end edges of said support panel;

(iii) a containment wall extending upwardly from the top face of said floor with a substantial portion thereof spaced horizontally from and substantially parallel with the plane of said first face of said support panel; and (iv) means projecting from said first face adapted to impede flow of air between said first face of said support panel and said substantially vertical panel.

* * * * *